US009222756B1

(12) United States Patent
Battaglia et al.

(10) Patent No.: US 9,222,756 B1
(45) Date of Patent: Dec. 29, 2015

(54) MODULAR RAIL THRUST BLOCK SYSTEM

(71) Applicant: Vincent P. Battaglia, Easton, CT (US)

(72) Inventors: Vincent P. Battaglia, Easton, CT (US); Philip Battaglia, Easton, CT (US)

( * ) Notice: Subject to any disclaimer, the term of this patent is extended or adjusted under 35 U.S.C. 154(b) by 0 days.

(21) Appl. No.: 14/676,108

(22) Filed: Apr. 1, 2015

Related U.S. Application Data

(60) Provisional application No. 61/974,121, filed on Apr. 2, 2014.

(51) Int. Cl.
*F41C 27/00* (2006.01)
*F41C 23/16* (2006.01)
*F41G 11/00* (2006.01)

(52) U.S. Cl.
CPC ..... *F41G 11/003* (2013.01); *F41C 27/00* (2013.01); *F41G 11/004* (2013.01); *F41C 23/16* (2013.01)

(58) Field of Classification Search
CPC ..... F41G 11/003; F41G 1/387; F41G 11/004; F41C 23/16; F41C 27/00
See application file for complete search history.

(56) References Cited

U.S. PATENT DOCUMENTS 7,216,451 B1 * 5/2007 Troy ..... F41C 23/16 42/71.01
7,694,450 B2 * 4/2010 Keng ..... F41G 11/003 42/124
7,870,688 B1 * 1/2011 Dasiukevich ..... F41G 11/004 248/229.1
8,341,866 B1 * 1/2013 Gaddini ..... F41G 11/003 42/71.01
8,752,325 B2 * 6/2014 Ding ..... F41G 11/003 42/124
2004/0000083 A1 * 1/2004 Grant, Jr. ..... F41G 11/003 42/112
2005/0268513 A1 * 12/2005 Battaglia ..... F41C 23/16 42/71.01
2010/0205795 A1 * 8/2010 Moody ..... F41A 23/08 29/428
2011/0271578 A1 * 11/2011 Karagias ..... F41G 11/003 42/124
2012/0017482 A1 * 1/2012 Chvala ..... F41G 11/003 42/71.01
2012/0159831 A1 * 6/2012 LaFrance ..... F41G 11/001 42/90

* cited by examiner

*Primary Examiner* — Troy Chambers
*Assistant Examiner* — Adam J Zimmer
(74) *Attorney, Agent, or Firm* — DeLio, Peterson & Curcio LLC; Peter W. Peterson

(57) ABSTRACT

A rail mounting system for a firearm includes a shroud on the fore end having a plurality of spaced rectangular pads with raised, rectangular top surfaces and opposed sloping sides forming an opposed pair of side walls that intersect with the shroud surface at an acute angle. The rail mounting system also includes a mounting rail having spaced apart relief sections conforming to the locations of the pads with recessed rectangular relief bottoms and opposed sloping sides forming an opposed pair of angled side walls at the same angle as the pad side walls. The side walls of the pads and relief sections are in contact with each other along at least some of their vertical distances. The pad top is spaced from the relief bottom and the shroud surface is spaced from the rail underside.

13 Claims, 4 Drawing Sheets

MODULAR RAIL THRUST BLOCK SYSTEM

This application claims priority to U.S. application No. 61/974,121 filed on Apr. 2, 2014.

BACKGROUND OF THE INVENTION

1. Field of the Invention

The present invention is directed to a thrust block system that permits a modular rail to be removably mounted onto the shroud or fore end of a firearm.

2. Description of Related Art

A removable rail mounting system on a shroud around a firearm barrel may be used to attach one or more accessories to the firearm. An example of such modular rail is the Picatinny rail, also known as a MIL-STD-1913 rail, STANAG 2324 rail, or tactical rail. Such a rail provides a standard mounting platform for accessories and attachments. During recoil, the rail and accessory are subject to movement if the rail is not properly secured to the shroud. Such movement may require the user to periodically re-align the accessory between shots.

SUMMARY OF THE INVENTION

Bearing in mind the problems and deficiencies of the prior art, it is therefore an object of the present invention to provide a rail and accessory mounting system that restricts movement of the accessory and any rail on which it is mounted with respect to the shroud in directions along and normal to the shroud and barrel axis.

It is another object of the present invention to provide heat shielding in the shroud for the firearm barrel.

Still other objects and advantages of the invention will in part be obvious and will in part be apparent from the specification.

The above and other objects, which will be apparent to those skilled in the art, are achieved in the present invention which is directed to a mounting system for a firearm fore end having on a surface thereof a plurality of spaced rectangular pads each having a raised, rectangular top surface with at least two opposed sloping sides forming an opposed pair of side walls that intersect with the fore end surface at an acute angle. The system comprises a mounting rail or accessory having on a surface thereof spaced apart relief sections conforming to the locations of the pads. Each relief section has a recessed rectangular relief bottom with at least two opposed sloping sides forming an opposed pair of angled side walls at the same angle as the side walls of the pads. The angled side walls of the pads and relief sections extend in a direction along or normal to the longitudinal axis of the shroud. When the relief sections are placed over the pads the side walls of the pads and relief sections are in contact with each other along at least some of their vertical distances, the pad top is spaced from the relief bottom and the fore end surface is spaced from the rail or accessory surface. The rail or accessory is securable to the fore end by one or more fasteners.

The firearm fore end may have a shroud secured thereon having the spaced rectangular pads mounted on a surface thereof. The shroud may have on an interior surface thereof a heat-resistant, heat shielding material to restrict heat transfer from the barrel when the shroud is secured thereover. The spaced apart relief sections may be on an underside of a mounting rail.

The angled side walls of the pads and relief sections may extend in a direction along or normal to the longitudinal axis of the shroud. The system may include an aperture through the pad and through relief section to receive a fastener to secure the rail or accessory to the firearm fore end.

In another aspect, the present invention is directed to a rail mounting system for a firearm comprising a shroud for a firearm barrel having on a surface thereof a plurality of spaced rectangular pads each having a raised, rectangular top surface with at least two opposed sloping sides forming an opposed pair of side walls that intersect with the shroud surface at an acute angle. The rail mounting system includes a mounting rail having on an underside thereof spaced apart relief sections conforming to the locations of the pads. Each relief section has a recessed rectangular relief bottom with at least two opposed sloping sides forming an opposed pair of angled side walls at the same angle as the side walls of the pads. The angled side walls of the pads and relief sections extend in a direction along or normal to the longitudinal axis of the shroud. The side walls of the pads and relief sections are in contact with each other along at least some of their vertical distances. The pad top is spaced from the relief bottom and the shroud surface is spaced from the rail underside. The rail is securable to the shroud by one or more fasteners.

The rail mounting system may include at least one pad and relief section with the contact side walls thereof extending in a direction along the longitudinal axis of the shroud and at least one pad and relief section with the contact side walls thereof extending in a direction normal to the longitudinal axis of the shroud. The shroud may have on an interior surface thereof a heat-resistant, heat shielding material to restrict heat transfer from the barrel when the shroud is secured thereover. The rail mounting system may include an aperture through the pad and through relief section to receive a fastener to secure the rail to the shroud.

In a further aspect, the present invention is directed to a method of mounting an accessory to the fore end of a firearm comprising initially providing on a surface of the firearm fore end a plurality of spaced rectangular pads each having a raised, rectangular top surface with at least two opposed sloping sides forming an opposed pair of side walls that intersect with the fore end surface at an acute angle. There is also provided a mounting rail or accessory having on a surface thereof spaced apart relief sections conforming to the locations of the pads. Each relief section has a recessed rectangular relief bottom with at least two opposed sloping sides forming an opposed pair of angled side walls at the same angle as the side walls of the pads. The angled side walls of the pads and relief sections extend in a direction along or normal to the longitudinal axis of the shroud, such that when the relief sections are placed over the pads the side walls of the pads and relief sections are in contact with each other along at least some of their vertical distances, the pad top is spaced from the relief bottom and the shroud surface being is from the rail underside. The method includes placing the relief sections of the mounting rail or accessory over the pads of the firearm fore end such that the side walls of the pads and relief sections are in contact with each other along at least some of their vertical distances. The pad top is then spaced from the relief bottom and the fore end surface is spaced from the rail or accessory surface. The method also includes securing the rail or accessory to the firearm fore end.

The firearm fore end may have a shroud secured thereon having the spaced rectangular pads mounted on a surface thereof. The shroud may have on an interior surface thereof a heat-resistant, heat shielding material to restrict heat transfer from the barrel when the shroud is secured thereover. The spaced apart relief sections may be on an underside of a mounting rail.

The angled side walls of the pads and relief sections may extend in a direction along or normal to the longitudinal axis of the fore end.

The method may include providing an aperture through the pad and through relief section, and inserting a fastener into the pad and relief section apertures to secure the rail or accessory to the firearm fore end.

Another aspect of the invention is directed to a shroud for a firearm barrel having on an interior surface thereof a heat-resistant, heat shielding material to restrict heat transfer from the barrel when the shroud is secured thereover.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

The present invention provides a rifle fore end or shroud with multiple square projections with beveled walls, each housing a tap hole to receive a standard fastener, and to facilitate and receive a modular Picatinny rail of various lengths. A square projection secures and fastens the modular Picatinny rail in axes in the direction of and normal to the rifle bore, thereby isolating movement and recoil in a multi-axis fashion.

Figure 1:
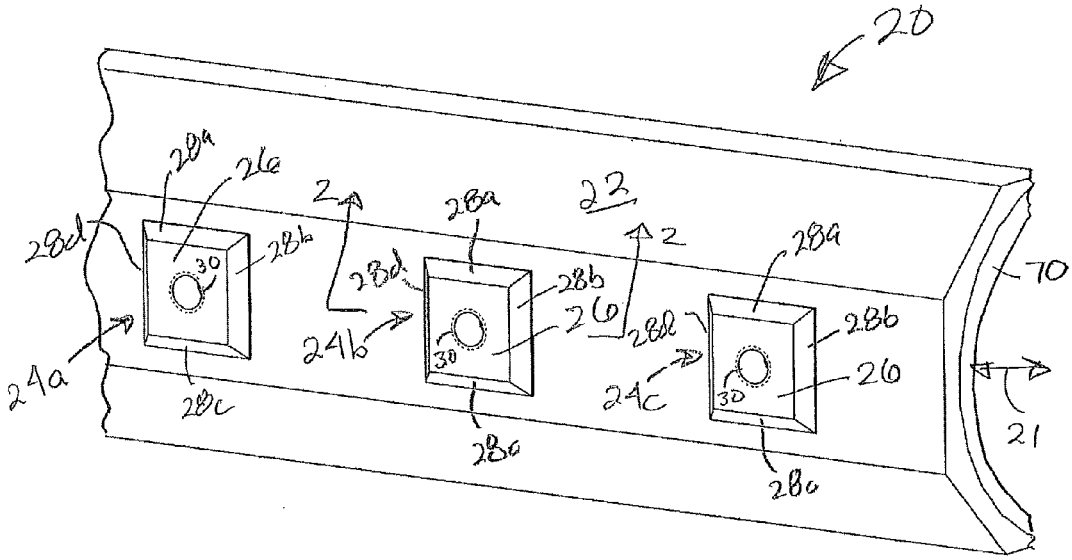
FIG. 1 is a perspective view of an end portion of the shroud of a firearm showing rectangular pads or blocks forming an embodiment of the modular rail thrust block system of the present invention.
Figure 2:
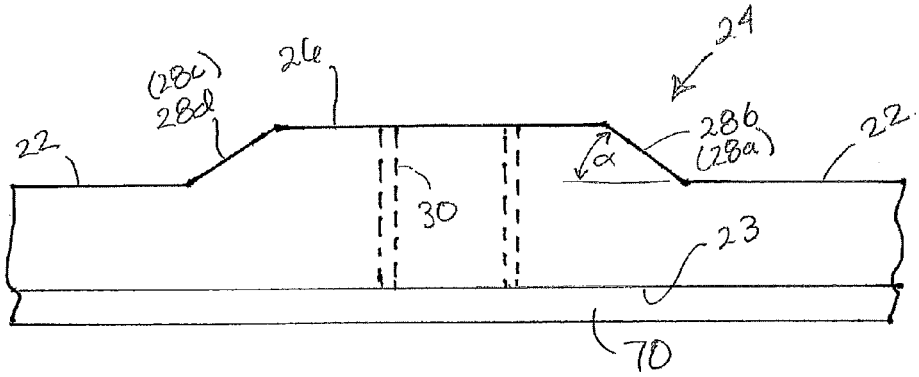
FIG. 2 is a sectional view of a portion of the shroud of FIG. 1 along lines 2-2 of FIG. 1.
Figure 5:
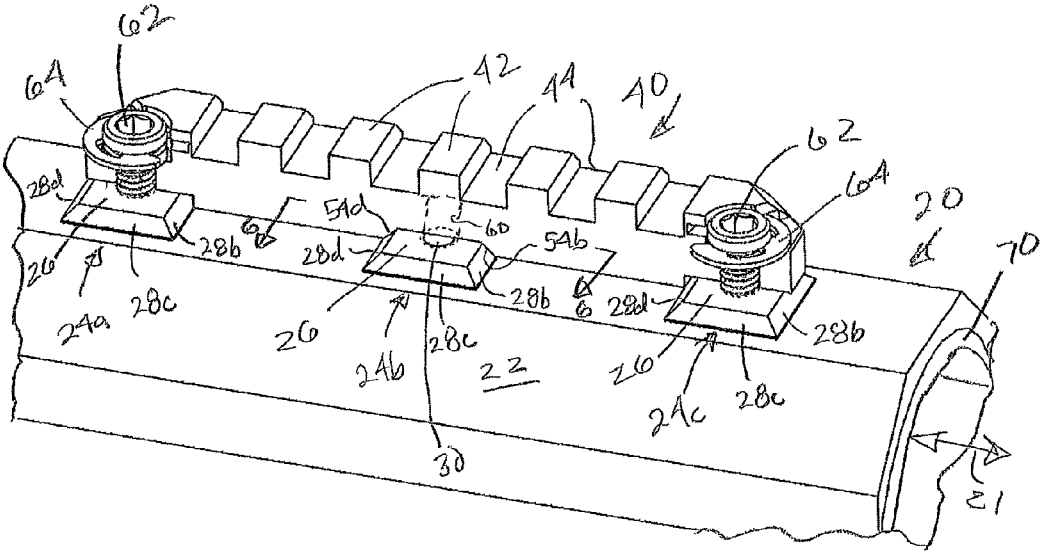
FIG. 5 is a perspective view of the modular rail of FIG. 3 installed onto the shroud of FIG. 1, with the modular rail sectioned along a centerline by a plane containing the longitudinal axis of the shroud so that half of the rail is shown.

FIGS. 1 and 5 show an otherwise standard shroud or fore end piece 20 that may function as a forestock for a rifle, to be attached to and over and/or around the barrel. The shroud may also be attached to the barrel of a revolver, or on the underside of a semi-automatic pistol frame. Shroud 20 may be in the form of a tube to fit over all or part of the barrel of the firearm. In order to attach a modular rail (discussed further below), shroud 20 has on the surface 22 of its housing a plurality of rectangular pads or blocks 24*a*, 24*b*, 24*c* of like configuration. By way of the example shown, each pad or block comprises a raised, flat, square, planar top surface 26 at a height above the shroud surface 22 and four sloping sides 28*a*, 28*b*, 28*c*, 28*d* forming two opposed pairs of same-length side walls that intersect with the shroud surface 22 in a square. Sides 28*a-d* extend at an acute angle $\alpha$ from the surface of shroud 20 (FIG. 2) at a range of, for example, about 20-70 degrees, or about 30-60 degrees. An exemplary angle may be about 45 degrees. Sides 28*a* and 28*c* are aligned along the direction of the axis 21 of the shroud or firearm barrel, while sides 28*b* and 28*d* are aligned normal (90 degrees) to the axis of the shroud or barrel. The pads 24*a*, 24*b*, 24*c* are spaced apart from each other along the length of the shroud. A threaded opening 30 extends from the center top surface 26 of some or all of the pads through the thickness of the shroud. The shroud may have an octagonal exterior surface when seen in a cross-section normal to the axis of the barrel, so that the pads 24 are on the same flat surface of the shroud and aligned along the direction of the barrel axis. The one or more pads 24 comprise the thrust block system of the present invention.

As an alternative, one or more rectangular pad or block 24 may be disposed directly on the fore end or barrel of the firearm, and extend above the surface thereof in the same manner as on shroud surface 22.

Figure 3:
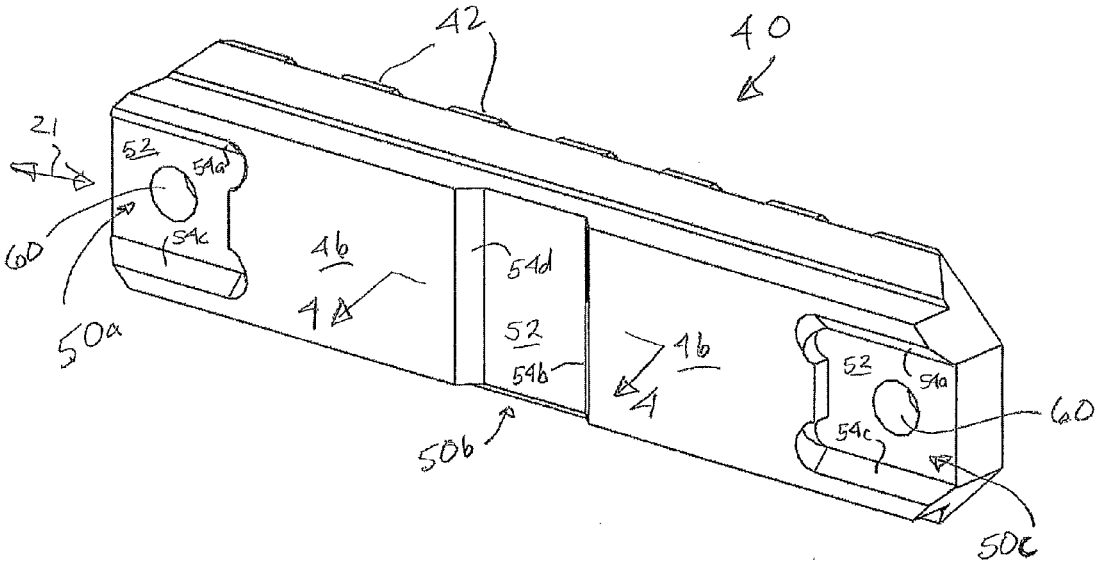
FIG. 3 is a perspective view of the modular rail of the present invention showing the underside and relief sections thereon.
Figure 4:
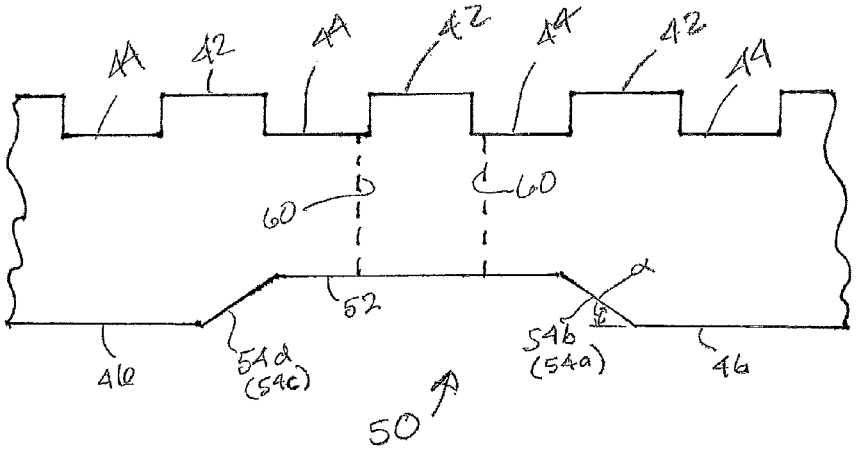
FIG. 4 is a sectional view of a portion of the rail of FIG. 3 along lines 4-4 of FIG. 3.

An example of the modular rail that may be mounted on the thrust block system is shown in FIGS. 3 and 5 as 40 and comprises an elongated rail to be removably mounted to the shroud 20. The top and side working surfaces of the modular rail 40 may conform to the Picatinny rail, also known as a MIL-STD-1913 rail, STANAG 2324 rail, or tactical rail. It provides a standard mounting platform for accessories and attachments, such as scopes, tactical lights, laser aiming modules, night vision devices, reflex sights, foregrips, bipods, bayonets, shoulder strap bushings and the like. The Picatinny rail consists of a series of spaced-apart ridges thrust lugs 42 along the length of the rail, each with a T-shaped cross-section (when seen in cross-section normal to the barrel axis) interspersed with flat spacing slots or channels 44. Accessories may be mounted either by sliding them on from one end or the other, or onto the slots between the raised sections. The standard Picatinny locking slot width is 0.206 in. (5.23 mm); the spacing of slot centers is 0.394 in. (10.01 mm) and the slot depth is 0.118 in. (3.00 mm).

Modular rail 40 has on its planar underside 46 of its length (FIG. 3) spaced apart relief sections 50*a*, 50*b*, 50*c* conforming to the locations of the pads 24*a*, 24*b*, 24*c*. As shown in the example, each relief section has a flat rectangular relief bottom 52 at a height above the underside 46 and two opposed angled side walls. Relief sections 50*a* and 50*c* at opposite ends of the modular rail 40 have opposite angled side walls 54*a*, 54*c* that are parallel to and aligned along the longitudinal axis 21 of the rail and shroud. Central relief section 50*b* has opposite angled side walls 54*b*, 54*d* that are normal to and aligned 90 degrees to axis 21. Some or all of relief sections 50 have an opening 60 that extends from the center of planar relief bottom 52 through the thickness of the rail to the upper surface, to permit the shank of a threaded fastener 62 to pass therethrough to engage the threads of shroud opening 30. Where openings 60 are provided, the thrust lugs 42 should be cut away to permit the fastener heads to be seated sufficiently with E-clips 64 against the rail top so that the heads do not interfere with the connection of accessories to the rail. The modular rail may have securing fasteners at a mated relief/pad at each end thereof, and optionally in a central mated relief/ pad. Accordingly, the centers of the relief bottoms should be spaced apart at the same distance as the centers of the shroud pads. The relief side walls 54*a-d* are angled with respect to the plane of underside 46 at the same angle(s) α (FIG. 4) as those of side walls 28*a-d* of the shroud pads so that close contact can be achieved between these side walls when the modular rail 40 is installed onto the shroud (FIG. 5).

Figure 6:
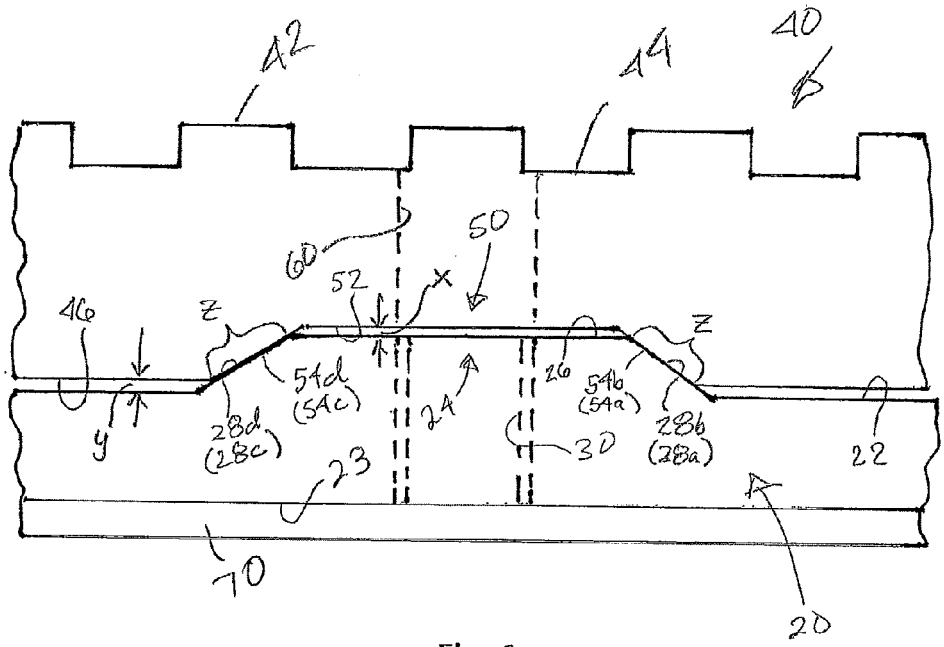
FIG. 6 is a sectional view of a portion of the modular rail and shroud combination of FIG. 5 along lines 6-6 of FIG. 5.

When the rail is installed over the shroud, the respective side walls of the relief sections 50 and pads 24 may make contact over some but not all of their vertical distances. As shown in FIG. 6, the bottom 52 of relief 50 has a smaller horizontal length than the top 26 of pad 24, and horizontal dimension the top of relief 50 is smaller than the base of pad 24. The result is that the relief bottom 52 is spaced from the pad top 26, for example, by a distance of about 0.003 to about 0.006 in., and rail underside 46 is spaced from shroud surface 22 by a similar distance. The vertical contact between corresponding relief section 50*b* side wall and pad 24 *b* side wall pairs 54*b*, 54*d* and 28*b*, 28*d*, respectively, is along distance z. The vertical contact between corresponding relief side wall and pad side wall pairs 54*a*, 54*c* and 28*a*, 28*c*, respectively, for relief sections 50*a*, 50*c* and pads 24*a*, 24*c* would likewise be along distance z as shown in FIG. 6. This contact point as shown in the vertical cross section of FIG. 6 establishes what also known as the gage point or point of compression between the pads and relief sections.

Figure 7:
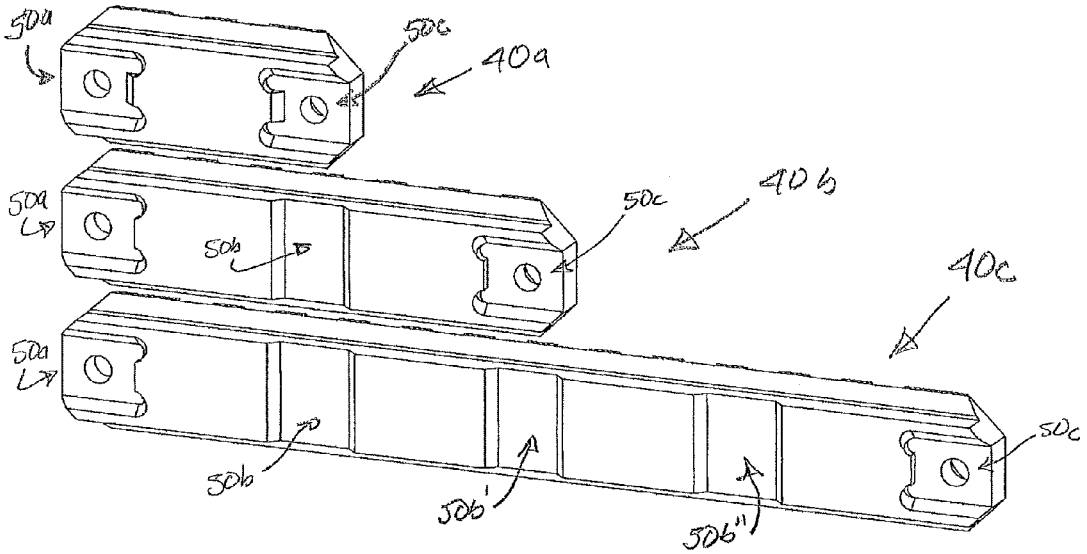
FIG. 7 is a perspective view of three different modular rails of the present invention showing the underside relief sections.

Three exemplary modular rails are depicted in FIG. 7. Rail 40*a* has relief sections 50*a*, 50*c* at the ends, with no center relief section 50*b* therebetween. Rail 40*b* has relief sections 50*a*, 50*c* at the ends, with one center relief section 50*b* therebetween. Rail 40*c* has relief sections 50*a*, 50*c* at the ends, with three center relief sections 50*b*, 50*b*', 50*b*" therebetween.

When installed with the fasteners, the pair of mated relief/pad sections 50*a*/24*a* and 50*c*/24*c* at the rail ends prevent or at least restrict movement of the rail with respect to the shroud in a horizontal direction normal to the shroud and barrel axis 21. When the rail has one or more pairs of mated relief/pad sections 50*b*/24*b* in a central portion, movement of the rail with respect to the shroud in a longitudinal direction along axis 21 is prevented or at least restricted. The angled contact along significant areas of the relief and pad side walls provides positive location and bi-directional retention of the rail and attached accessories under contact compression during recoil when the firearm is fired. This may be achieved without the use of lock washers on the fasteners.

Instead of using the rail system, one or more relief section 50 may be disposed on the surface of the accessory to be mounted to the firearm. Such an accessory may be any of the accessories or attachments described above, or any other firearm accessory typically mounted on the fore end of a firearm. When mounting such accessory directly on the thrust block 24 without the modular rail, the accessory would require an opening aligned with each relief section 50 to receive a fastener 62 to secure the accessory in the manner previously described.

Figure 8:
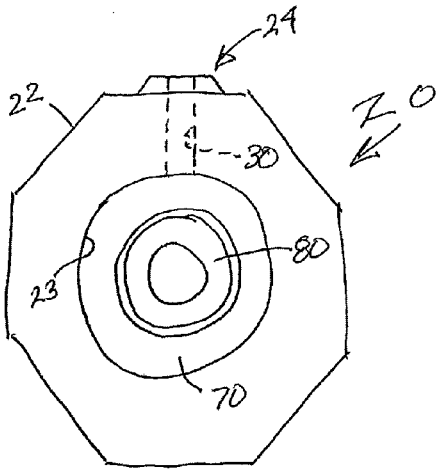
FIG. 8 is a cross-sectional view of the shroud of the present invention installed on a firearm barrel along a direction normal to the axis of the barrel showing a thermally insulating, heat shielding material on the inner surface of the shroud.

To restrict heat transfer from the barrel when the shroud is secured thereover, FIG. 8 shows fore end shroud 20 secured over firearm barrel 80. The shroud has on an interior surface 23 a heat-resistant, non-conductive, thermally insulating, heat shielding material 70. The cross-section of the shroud interior may be circular or oval. The retained screw aperture 30 extends through the entire thickness of the shroud, but any fastener securing the rail using the aperture does not extend beyond the interior diameter of the fore end shroud into the layer of heat shielding material 70. This creates a blind fastener hole above the weapons gun barrel.

Accordingly, the present invention therefore provides an accessory mounting system that restricts movement of the accessory and any rail on which it is mounted with respect to the firearm fore end in directions along and normal to the barrel axis.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A mounting system for a firearm fore end having on a surface thereof a plurality of spaced rectangular pads each having a raised, rectangular top surface with at least two opposed sloping sides forming an opposed pair of side walls that intersect with the fore end surface at an acute angle, the system comprising a mounting rail or accessory having on a surface thereof spaced apart relief sections conforming to the locations of the pads, each relief section having a recessed rectangular relief bottom with at least two opposed sloping sides forming an opposed pair of angled side walls at the same angle as the side walls of the pads, the angled side walls of the pads and relief sections extending in a direction along or normal to the longitudinal axis of the fore end, such that when the relief sections are placed over the pads the side walls of the pads and relief sections are in contact with each other along at least some of their vertical distances, the pad top is spaced from the relief bottom and the fore end surface is spaced from the rail or accessory surface, the rail or accessory being securable to the fore end by one or more fasteners, including at least one pad and relief section with the contact side walls thereof extending in a direction along the longitudinal axis of the fore end and at least one pad and relief section with the contact side walls thereof extending in a direction normal to the longitudinal axis of the fore end.

2. The system of claim 1 wherein the firearm fore end has a shroud secured thereon having the spaced rectangular pads mounted on a surface thereof.

3. The system of claim 2 wherein the shroud has on an interior surface thereof a heat-resistant, heat shielding material to restrict heat transfer from the barrel when the shroud is secured thereover.

4. The system of claim 1 wherein the spaced apart relief sections are on an underside of a mounting rail.

5. The system of claim 1 including an aperture through the pad and through relief section to receive a fastener to secure the rail or accessory to the firearm fore end.

6. A rail mounting system for a firearm comprising a shroud for a firearm barrel having on a surface thereof a plurality of spaced rectangular pads each having a raised, rectangular top surface with at least two opposed sloping sides forming an opposed pair of side walls that intersect with the shroud surface at an acute angle and a mounting rail having on an underside thereof spaced apart relief sections conforming to the locations of the pads, each relief section having a recessed rectangular relief bottom with at least two opposed sloping sides forming an opposed pair of angled side walls at the same angle as the side walls of the pads, the angled side walls of the pads and relief sections extending in a direction along or normal to the longitudinal axis of the shroud, the side walls of the pads and relief sections being in contact with each other along at least some of their vertical distances, the pad top being spaced from the relief bottom and the shroud surface being spaced from the rail underside, the rail being securable to the shroud by one or more fasteners, including at least one pad and relief section with the contact side walls thereof extending in a direction along the longitudinal axis of the shroud and at least one pad and relief section with the contact side walls thereof extending in a direction normal to the longitudinal axis of the shroud.

7. The rail mounting system of claim 6 including an aperture through the pad and through relief section to receive a fastener to secure the rail to the shroud.

8. The rail mounting system of claim 6 wherein the shroud has on an interior surface thereof a heat-resistant, heat shielding material to restrict heat transfer from the barrel when the shroud is secured thereover.

9. A method of mounting an accessory to the fore end of a firearm comprising: providing on a surface of the firearm fore end a plurality of spaced rectangular pads each having a raised, rectangular top surface with at least two opposed sloping sides forming an opposed pair of side walls that intersect with the fore end surface at an acute angle; providing a mounting rail or accessory having on a surface thereof spaced apart relief sections conforming to the locations of the pads, each relief section having a recessed rectangular relief bottom with at least two opposed sloping sides forming an opposed pair of angled side walls at the same angle as the side walls of the pads, the angled side walls of the pads and relief sections extending in a direction along or normal to the longitudinal axis of the fore end, such that when the relief sections are placed over the pads the side walls of the pads and relief sections are in contact with each other along at least some of their vertical distances, the pad top is spaced from the relief bottom and the fore end surface being is from the rail underside; placing the relief sections of the mounting rail or accessory over the pads of the firearm fore end such that the side walls of the pads and relief sections are in contact with each other along at least some of their vertical distances, the pad top is spaced from the relief bottom and the fore end surface is spaced from the rail or accessory surface; and securing the rail or accessory to the firearm fore end by one or more fasteners, including at least one pad and relief section with the contact side walls thereof extending in a direction along the longitudinal axis of the fore end and at least one pad and relief section with the contact side walls thereof extending in a direction normal to the longitudinal axis of the fore end.

10. The method of claim 9 wherein the firearm fore end has a shroud secured thereon having the spaced rectangular pads mounted on a surface thereof.

11. The method of claim 10 wherein the shroud has on an interior surface thereof a heat-resistant, heat shielding material to restrict heat transfer from the barrel when the shroud is secured thereover.

12. The method of claim 9 wherein the spaced apart relief sections are on an underside of a mounting rail.

13. The method of claim 9 including providing an aperture through the pad and through relief section, and inserting a fastener into the pad and relief section apertures to secure the rail or accessory to the firearm fore end.

* * * * *